United States Patent [19]

Eigenbrod et al.

[11] 4,277,950

[45] Jul. 14, 1981

[54] CRYOGENIC LIQUID TRANSFER TERMINATION APPARATUS

[75] Inventors: Lester K. Eigenbrod, Indianapolis; Gerald F. Kidder, Speedway; Robert L. Zeunik, Carmel, all of Ind.

[73] Assignee: Union Carbide Corporation, New York, N.Y.

[21] Appl. No.: 125,889

[22] Filed: Feb. 29, 1980

[51] Int. Cl.[3] ..... F17C 7/02

[52] U.S. Cl. ..... 62/55; 141/5; 222/3

[58] Field of Search ..... 62/50, 51, 55; 222/3; 141/5

[56] References Cited

U.S. PATENT DOCUMENTS

| | | | |
|---|---|---|---|
| 2,362,724 | 11/1944 | Shea | 62/50 |
| 2,441,911 | 5/1948 | St. Clair | 62/50 |
| 2,889,688 | 6/1959 | Jones et al. | 62/55 |
| 3,363,641 | 1/1968 | Mylander | 137/393 |
| 3,797,262 | 3/1974 | Eigenbrod | 62/50 |
| 3,864,928 | 2/1975 | Eigenbrod | 62/50 |

*Primary Examiner*—Ronald C. Capossela
*Attorney, Agent, or Firm*—John J. Kelly, Jr.

[57] ABSTRACT

Apparatus for termination of cryogenic liquid transfer from a liquid supply container to a storage-dispensing container.

7 Claims, 8 Drawing Figures

CRYOGENIC LIQUID TRANSFER TERMINATION APPARATUS

BACKGROUND OF THE INVENTION

1. Field of the Invention

This invention relates generally to a cryogenic liquid storage-gas supply system, as for example a portable oxygen system used by individuals for personal breathing.

2. Description of the Prior Art

The transfer of cryogenic liquid from a supply container into a smaller storage-dispensing container such as a portable breathing apparatus must meet the following requirements:

(a) The transfer should be made rapidly.

(b) Losses of cryogenic fluid by vapor generation, should be minimized.

(c) Adequate equilibrium pressure of liquid transferred into the storage-dispensing container should be preserved to facilitate complete withdrawal.

(d) The transfer should be terminated with enough precision to avoid significant underfill or overfill of the storage-dispensing container.

The above requirements must be met with due consideration of factors such as low bulk, weight and cost of component parts in the portable system, and compatibility of such components with cryogenic and oxygen gas service.

Rapid transfer is important for two reasons. First, rapid transfer is desirable in deference to the users' convenience. A practical portable oxygen gas breathing system must be capable of being filled and made ready for use in as short a span of time as possible.

Second, the transfer must be made rapidly in order to minimize loss of cryogenic fluid. Transfer loss is an acute problem with a small portable oxygen gas breathing system because the heat gain per unit volume of liquid transferred tends to increase as the size of the system decreases. Rapid transfer reduces losses because it reduces exposure time of the cold fluid to surfaces in contact with ambient temperature during the transfer operation. Inefficient transfers can often result in more fluid being lost by vaporization than retained in the receiving container for useful employment.

The rate of cryogenic liquid transfer is dependent upon the pressure level of the supply container. A higher pressure affords greater driving force for transport of liquid between containers and for expulsion of vapor from the storage-dispensing container as fill progresses.

The rate of cryogenic liquid transfer is also dependent upon the rate at which vapor is generated during the transfer and upon the rate at which this vapor can be vented from the storage-dispensing container. Vapor generation is caused by the abovementioned heat gain of cryogenic liquid-in-transit, by heat gain of liquid contacting the warmer walls of the storage-dispensing container, and by flash-vaporization of cryogenic liquid passing from a higher pressure to a lower pressure container. The rate at which vapor is vented is limited by the flow resistances in the venting system. Because of such vent-flow resistances, a higher rate of vapor generation will result in a higher pressure in the storage-dispensing container and a consequent reduction of the cryogenic liquid transfer rate into this container. The slower transfer rate in turn results in still greater heat leak into the cryogenic liquid passing through the external conduit system, thereby further aggravating the vapor-generation problem attendant a container filling operation.

The foregoing problem cannot be solved merely by arbitrarily increasing the size of the various components in the venting system in order to reduce their flow resistance. Undue elimination of flow resistance in the venting circuit will shift a substantial part of the overall pressure difference (supply container-to-atmosphere) to the liquid transfer conduit, and will result in excessive loss of pressure in the storage-dispensing container. Whereas a low container pressure will accelerate the cryogenic liquid transfer rate, it will also greatly increase the flash-vaporization of the cryogenic liquid which must now reject sufficient internal heat by vaporization to reach equilibrium at the lower pressure. Thus, the cryogenic fluid transfer losses can become excessive, even with high transfer rate. Moreover, the lower equilibrium pressure of the cryogenic liquid may be inadequate for subsequent dispensing of the gas through a breathing system or other consuming apparatus.

U.S. Pat. Nos. 3,797,262 and 3,864,928 to Eigenbrod disclose a liquid oxygen breathing apparatus which satisfies the basic requirements for such a system. The portable storage-dispensing container is closecoupled to the reservoir or supply container, which minimizes the mass and surface area of warm material contacted by the cryogenic liquid in the conduit system, thereby reducing warm-up of the cryogenic liquid conducted through the conduit system during transfer. A vapor venting system is used with the storage-dispensing container which contains minimum flow restriction, consistent with pressure-retention requirements for the cryogenic liquid stored in the portable container. These features afford rapid transfer of cryogenic liquid between the supply and storage-dispensing containers. Moreover, the proper flow restriction can be provided in the vapor venting system so as to retain adequate pressure in the storage--dispensing container yet permit rapid expulsion of vapor from this container, such pressure difference representing a desirable combination of rapid cryogenic liquid transfer and reduced flash-vaporization of liquid.

Eigenbrod U.S. Pat. Nos. 3,797,262 and 3,864,928 disclose an automatic cryogenic liquid fill termination valve which operates in response to the appearance of liquid in the vent fluid. The presence of cryogenic liquid is sensed by temperature or pressure change in the venting system upstream the vent valve, and a signal is generated and transmitted through an external circuit (electrical or pneumatic) to the valve.

Although the portable oxygen storage-dispenser container of Eigenbrod U.S. Pat. Nos. 3,797,262 and 3,864,928 can be filled reliably, repeatedly and dependably without overfilling or discharging cryogenic liquid, the fill-termination controls account for appreciable fractions of the total weight, bulk and cost of the system. The automatic vent valve which closes upon a signal from the sensor is disclosed as either a four-way, pressure-operated valve or an electric solenoid valve. The former valve is a rather complex, expensive device requiring rigid specifications and meticulous quality control to insure satisfactory performance. The latter valve additionally requires a thermistor or similar sensor, a relay controller and a source of electric power.

An object of this invention is to provide an improved apparatus for terminating the flow of cryogenic liquid from a supply container into storage-dispensing container.

Another object is to provide such improved apparatus which is reliable, very compact, lightweight and low cost.

Other objects and advantages will be apparent from the ensuing disclosure and appended claims.

SUMMARY

This invention relates to apparatus for termination of cryogenic liquid transfer from a supply container to a storage-dispensing container.

The invention involves a cryogenic liquid storage-gas supply system, including a thermally insulated cryogenic liquid supply container, a thermally insulated liquid storage-dispensing container, liquid transfer conduit means with an inlet end terminating in the bottom part of the supply container and a discharge end terminating in the storage-dispensing container. The system includes vapor vent conduit means with an inlet end terminating in the upper part of the storage-dispensing container in the liquid transfer position, and an outlet end outside the containers and open to the atmosphere.

More specifically, the invention is an improved cryogenic liquid transfer termination assembly comprising:

(a) first fluid flow resistance means in the vapor vent conduit means;

(b) a quick-closing plug-type valve in the vapor vent conduit means being positioned between the first fluid flow resistance means and the vapor vent conduit means outlet end. This valve is (i) separated from the first fluid flow resistance means by an uninsulated length of the vapor vent conduit, (ii) has a valve seat, (iii) a plug member contiguously positioned against the upstream surface of the valve seat, (iv) mechanical spring means positioned to urge the plug away from the valve seat, and (v) plug movement means having a first end rigidly joined to the plug and a second end in fluid communication with the first fluid flow resistance means through a higher pressure length of the vapor vent conduit. The liquid transfer termination assembly also includes the features of (c) the higher pressure length of the vapor vent conduit being arranged and constructed without substantial fluid flow constriction when the plug is urged away from the seat;

(d) second fluid flow resistance means having less fluid flow resistance than the first fluid flow resistance means, and positioned between the plug movement means second end and the vapor vent conduit means outlet end to provide a lower pressure length; and (e) manual opening means for the quick-closing plug-type valve, positioned within the vapor vent conduit means outside the storage-dispensing container.

We have found that the cryogenic liquid transfer termination assembly of this invention advantageously employs the previously defined quick-closing plug-type valve with the characteristics (i) through (v). This is a novel usage of such valve because the static driving force between the liquid storage-dispensing container and the atmosphere remains essentially constant during operation of the valve. Such usage is a radical departure from prior art usage wherein the static driving force across the conduit system containing the valve must increase drastically for operation to occur, as by sudden decrease in downstream pressure, eg. by conduit breakage, or by sudden increase in upstream pressure, eg. upon energy supplied abruptly by a pump.

Prior art valves of the quick-closing plug-type must be modified from their commercially available form to function in the manner of this invention. By way of illustration, the mechanical spring means urging the plug away from the valve seat in the open position must have an unusually low strength so that reliable operation will be effected by a very small increase in closing force on the spring produced by a redistribution of the pressure drops within the conduit circuit containing the valve without reliance upon a large increase in the total fluid-driving force through the vapor vent conduit circuit containing the valve. The mechanical spring providing the open-position bias is preferably selected such that the valve will close when passing ambient temperature air to the atmosphere with an upstream pressure less than 25% of the storage-dispensing container maximum gauge pressure during transfer and preferably less than 15% of such gauge pressure. This specification for selection of the valve mechanical spring assures that the valve will possess sufficient responsiveness so that closure occurs promptly and dependably upon cryogenic liquid appearance in the uninsulated length of the vapor vent conduit, thereby providing precise control and avoiding overfill. The mechanical spring holding the plug movement means in the open position must be sufficiently strong to resist the relatively light closing force produced by vapor only flow so as to avoid premature closure during the transfer operation. This requirement imposes a lower preferred pressure limit below which the valve will not close when passing vapor only. This lower preferred pressure limit is at least 5% of the storage-dispensing container maximum gauge pressure during transfer. It should be understood that the fluid passing through the vapor vent conduit means will change from a vapor upstream the first fluid flow resistance means to a superheated gas at the conduit means outlet end.

It should be understood that when liquid enters the uninsulated conduit length the pressure drop across the quick-closing plug-type valve will rise sharply to a value of perhaps 15% or more of the storage-dispensing container gauge pressure. This rise in pressure drop occurs as a result of a redistribution of pressure difference along the vapor vent conduit, and is accompanied by a corresponding decrease in pressure drop across the first fluid flow resistance means.

The lightweight mechanical spring used in the quick-closing plug-type valve in turn requires that the fluid flow resistance in the vapor vent conduit means upstream of the valve be properly selected and controlled. The upstream resistances must be sufficient to reduce the pressure at the valve inlet to a low value below that which will overcome the lightweight spring and close the valve when passing vapor only. By way of illustration and based on a liquid oxygen storage-dispensing container gauge pressure preference of about 40–65 psig, the mechanical spring is selected to permit valve closure with an upstream pressure of 7 psig of ambient temperature air discharging to the atmosphere. Accordingly, with this preferred mechanical spring for the practice of the invention, the first fluid flow resistance means is selected so as to reduce the valve inlet pressure to below 7 psig when venting vapor only with the liquid storage-dispensing container pressure at the highest value expected in operation.

The foregoing distribution of fluid flow resistance along the vent-charging termination flow circuit may be obtained with high or low venting rate depending upon the vapor conducting capacity of the circuit. A relatively high venting rate, consistent with pressure retention requirements in the storage-diepensing container is desirable to obtain rapid liquid transfer from the supply container and thereby minimize transfer losses.

Figure 1:
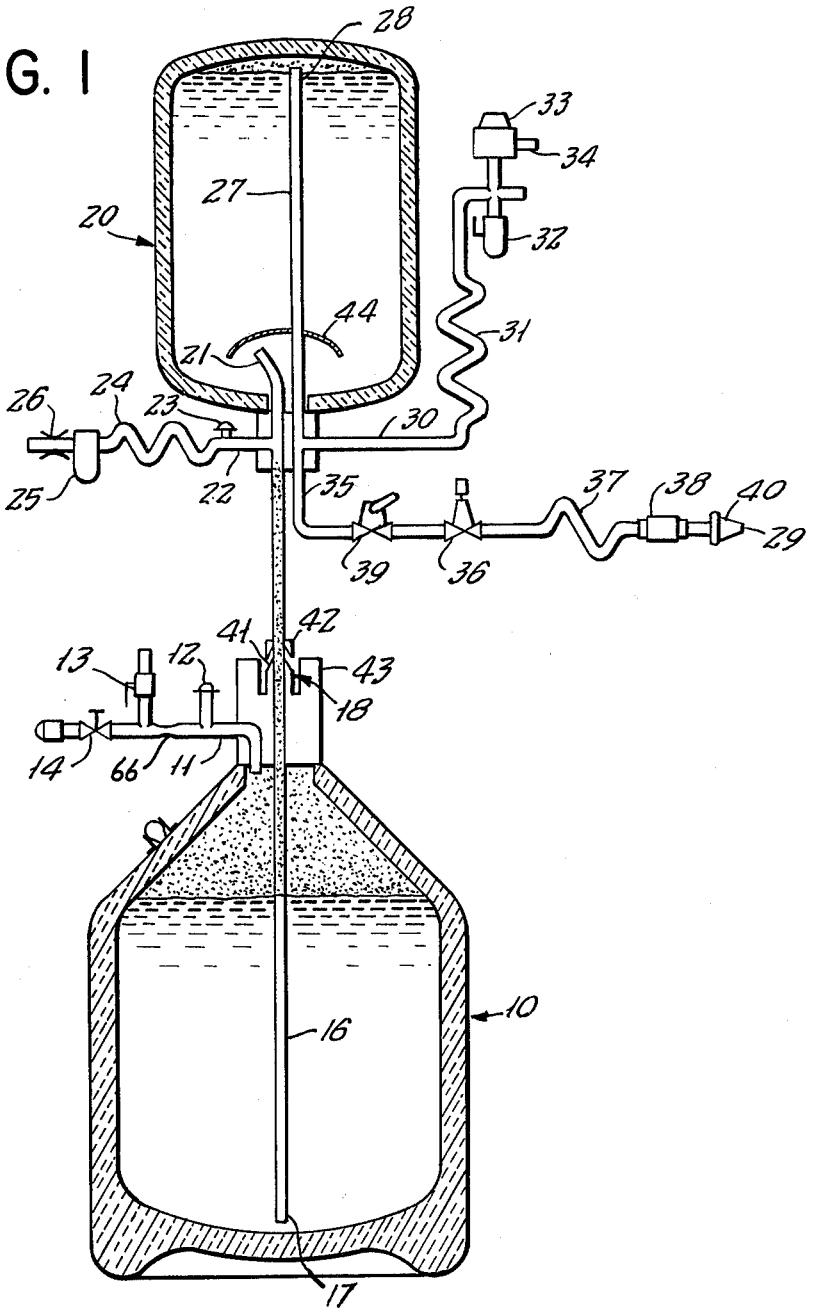
FIG. 1 is a schematic drawing in cross-sectional elevation of a cryogenic liquid supply container-storage and dispensing container assembly in the liquid fill position with the storage-dispenser inverted, and incorporating a liquid fill termination system embodiment of this invention.

In the drawings, various elements performing the same function in different illustrated embodiments are identified by numerals with the same last two digits.

DESCRIPTION OF THE PREFERRED EMBODIMENT

Referring now more specifically to the drawings, FIG. 1 illustrates an assembly including a thermally insulated cryogenic liquid supply container 10 holding for example, liquid oxygen saturated at a superatmospheric pressure of 50–55 psig. The container is provided with a vapor vent conduit 11 communicating with a bursting disc 12, a relief valve 13, and a vent valve 14, the latter being used when filling the supply container 10 from a source of cryogenic liquid. Liquid transfer conduit means, for example tube 16, is positioned with an inlet end 17 terminating in the bottom part of the container and extending upwardly through coupling device 18 attached to the upper end of container 10.

A thermally insulated cryogenic liquid storage-dispensing container 20 is joined to supply container 10 through liquid transfer conduit 16 and the conduit discharge end 21 with splash shield 44 terminates in the lowest part of container 20 in the liquid transfer position. In this particular embodiment, cryogenic liquid storage-dispensing container is invertible between a top-up position for dispensing cryogenic liquid and the illustrated bottom-up position for liquid transfer from supply container 10.

A primary pressure relief circuit 22 joins liquid transfer conduit 16 at a location in the latter intermediate containers 10 and 20. This circuit 22 includes bursting disc 23, first vaporizer 24, first relief valve 25, and flow-snubbing device 26. Vapor vent conduit means 27 is also provided with inlet end 28 terminating in the upper part of liquid storage-dispensing container 20 in the as-illustrated liquid transfer position. Conduit 27 extends outside container 20 with outlet end 29 open to the atmosphere. Branch conduit 30 joins vapor vent conduit 27 in the external portion thereof for liquid dispensing therethrough and comprises second vaporizer 31, secondary relief valve 32, flow control valve 33 and consumer connection 34.

The outer part of vapor vent conduit means 27 extends outside storage-dispensing container 20 and forms liquid transfer (fill) termination assembly 35. The latter includes first fluid flow resistance means in the form of needle valve 36, uninsulated conduit length 37 as a heat addition zone, and quick-closing plug-type valve 38. Manual opening means in the form of on-off valve 39 is provided in assembly 35 at any desired location outside container 20. Porous metal phase separator 40 may be provided at the open end 29 if desired.

As previously mentioned, in the FIG. 1 embodiment, the portable cryogenic liquid storage-gas supply system is shown in the "fill" position with portable container 20 inverted over supply container 10 having coupling portions 41 and 42 of liquid transfer conduit 16 fluid-joined tightly together. In such position, discharge end 21 of this conduit serves as a portion of the liquid conducting passage. However, when container 20 is in the upright liquid dispensing position, end 21 forms part of the primary pressure relief circuit 22. It will also be appreciated by those skilled in the art that whereas conduit 27 serves as the vapor vent during the illustrated liquid charging or transfer step, this same conduit becomes part of the liquid dispensing circuit through assembly 30 when container 20 is in the upright position.

Portable container 20 is filled by opening manual on-off valve 39, thereby venting vapor at flow-restricted rate from this container through vapor vent conduit 27 and liquid transfer termination assembly 35. The vapor escapes through manual opening valve 39, first flow restriction 36, non-insulated section 37, quick-closing plug-type valve 38, phase separator 40 and open end 29 to the atmosphere.

First flow resistance means 36 may be a needle valve as illustrated, or an appropriately sized orifice, or may be "built into" manual opening means 39 as a restricted port therein. As a further option, the first fluid flow resistance means may be provided as an appropriately sized section of conduit serving as part of assembly 35. A purpose of first fluid flow resistance means 36 is to maintain sufficient back-pressure on the cryogenic liquid in portable container 20 so that immediately after the filling operation is completed, the container 20 liquid may be dispensed to the consumer under its own pressure. If such back-pressure is not maintained, not only will the liquid lose its thermal energy needed for dispensing, but in addition a large amount of the liquid being transferred will flash off as vapor and will be needlessly lost through the vent system.

Figure 2:
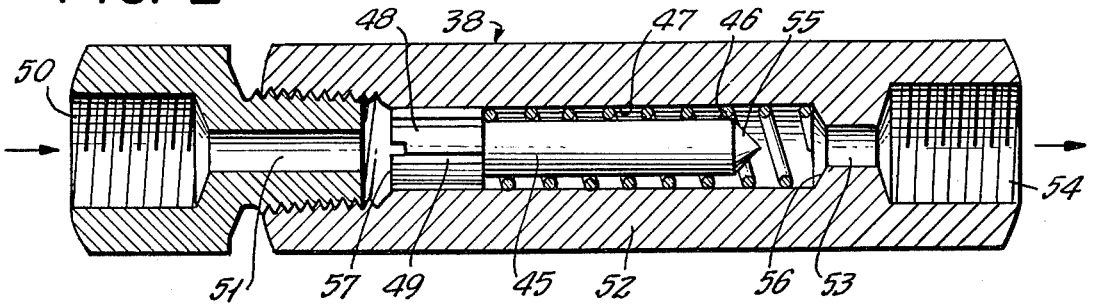
FIG. 2 is a cross-sectional view of quick-closing plug-type valve employing a piston as the plug movement means and suitable for use in the FIG. 1 embodiment.

A suitable excess flow, quick-closing embodiment of valve 38 is shown in FIG. 2. A free piston 45 is biased toward the open position by mechanical spring 46. The piston 45 is guided in its cylindrical bore 47 by an enlarged diameter portion 48 which retains spring 46 and which is provided with axial grooves 49. Fluid entering the inlet 50 flows through entrance port 51, through axial grooves 49, axially through the annular gap between valve body 52 and the reduced-diameter portion of the piston 45 and through exit port 53 and is discharged through outlet 54. Upstream end 57 of piston 45 is in fluid communication with first fluid flow resistance means 36 of FIG. 1 through a higher pressure length of the vapor vent conduit. If the fluid velocity through the FIG. 2 valve 38 exceeds a critical value, sufficient force is exerted by the fluid on piston 45 to overcome the counteracting force of spring 46. The piston is then driven forward in the flow direction until the plug in the form of piston tip 55 seals against the upstream surface of valve seat 56. The plug 55 is held in the closed position by full upstream static pressure exerted against the piston 45.

Summarizing the FIG. 2 quick-closing plug-type valve 38 operation in the generic language of this invention, piston 45 is the plug movement means having a first end rigidly joined to (in fact integrally with) tip 55 as the valve plug, and a second or upstream end 57 in fluid communication with first flow resistance 36. The enlarged portion 48 of piston 45 with annular grooves 49 comprising the second fluid flow resistance means, is positioned between the plug movement means second end 57 and vapor vent conduit outlet end 29.

In order that the valve will operate fast and dependably, it is necessary to generate a strong, sharp pressure pulse by vaporization of liquid in the warm conduit downstream of the first flow resistance. The liquid which is flash-vaporized is partially "trapped" within the higher pressure length of the vapor vent conduit between the first and second flow resistances. The plug movement means second end 57 must be in open, unrestricted communication with that portion of the vent conduit where vaporization occurs and where the pressure pulse is generated. Therefore the vent conduit section between the first flow resistance 36 and the plug movement means second end 57 is devoid of any substantial flow passage constriction.

In preferred practice of the invention the first flow restriction 36 is a device designed to introduce a localized, predetermined pressure drop upstream the uninsulated conduit length 37, i.e. the heat addition zone. Suitable preferred devices are an orifice, a porous plug and a needle valve. The pressure drop through the first flow restriction should constitute a substantial part of the total pressure drop between a point immediately upstream the restriction and the vapor vent conduit outlet end 29. A relatively high $\Delta P$ across the first flow restriction 36 is advantageous because the pressure surge accompanying entry of liquid into the heat addition zone 37 will direct fluid flow preferentially through quick-closing plug-type valve 38. The reverse flow of fluid into container 20 will be largely obstructed by the first flow restriction, the pressure "spike" in the heat addition zone 37 will be sharper, and the response of valve 38 will be more rapid and positive. If back flow into the container 20 is allowed to occur freely, the system may respond to liquid carryover by surging cyclically at low amplitude, as is well known to those skilled in the art. In preferred practice, the first flow restriction should be designed to provide 70–80% of the storage-dispensing container maximum gauge pressure during liquid transfer so that the pressure spike will be transmitted downstream to the quick-closing plug-type valve and will not be dissipated backwardly to the container.

After passing manual opening valve 39 and first flow restriction 36, the escaping vapor continues through uninsulated length 37 of tubing exposed to ambient room temperature. The vapor is then released to the atmosphere through valve 39 and optionally through a phase separator 40.

Returning to FIG. 1, when manual on-off valve 39 is opened, cryogenic liquid transfer into container 20 proceeds solely under the pressure difference between the two containers. Vapor which is generated as cold liquid enters container 20 and which is displaced by liquid entering the container escapes through the vent system 27 and 35 to the atmosphere. When container 20 is filled to a desired level corresponding to the inlet 28 of conduit 27, liquid passes with the vapor into and through the vent system. When liquid reaches nonthermally insulated heat addition zone 37, it vaporizes rapidly, increasing its volume by several hundred-fold. The sudden surge in velocity "trips" the quick-closing plug-type valve 38 and closes the liquid transfer termination circuit 35. When this occurs, liquid transfer into container 20 continues only momentarily until pressures in the two interconnected containers 10 and 20 are equalized. The transfer of liquid then ceases, valve 39 is closed manually and container 20 is disconnected at couplings 41 42 and returned to its upright position.

It should be noted that conduit couplings 41, 42 are joined to self-sealing coupling 43 which automatically closes both portions thereof when disconnected, and which automatically opens both portions when engaged. A common design employs a pressure-sealed valve in each portion with a stem protruding axially outwardly. When the coupling portions are brought together, the protruding stems contact one another, and when the portions are fully engaged, the stems force the valves off their respective seats.

When manual valve 39 is closed, quick-closing plug-type valve 38 may be reset to its open position in readiness for the next fill operation. Resetting is conveniently accomplished by notching or indenting tip 55 or seat 56 of valve 38 (not illustrated). This allows the upstream static pressure exerted on piston 45 to slowly bleed off to the atmosphere, eventually allowing spring 46 to return the piston to its retracted, full-open position.

In its normal upright position, the dispensing container and liquid transfer termination system is protected against overpressure by a dual relief system of the type described in Eigenbrod U.S. Pat. No. 3,864,928. Overpressure due to normal evaporation is relieved through the primary relief circuit 22 including elements 23, 24, 25 and 26. In the abnormal situation wherein vapor generation in dispensing container 20 exceeds the flow capacity of snubber 26, the excess overpressure is relieved through the secondary relief circuit 30 including elements 31 and 32.

Figure 3:
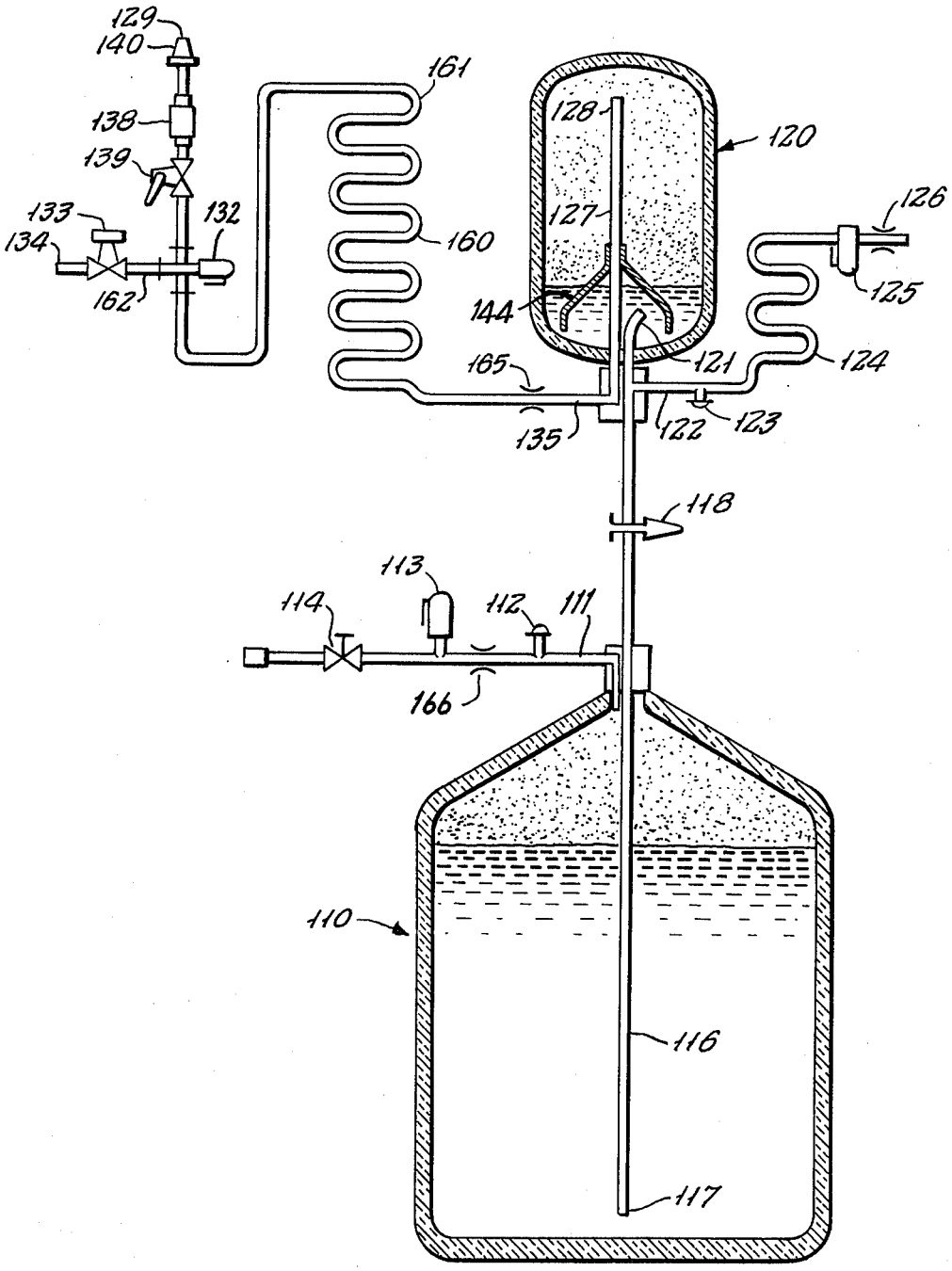
FIG. 3 is a schematic drawing of another inverted liquid fill assembly similar to FIG. 1, but with the first vaporizer 31—and second vaporizer 37—in a single heat exchanger 160.

FIG. 3 shows another type of inverted-fill container useful for dispensing gas at controlled rate through a vaporizer and employing the liquid transfer termination assembly of this invention. Compared to FIG. 1, the FIG. 3 arrangement combines the heat addition zone 37 and the second vaporizer 31 of FIG. 1, in a single heat exchanger 160. Thus, liquid dispensing conduit 127 of container 120 does not divide into two external branches until downstream of the heat exchanger 160. After the heat exchanger 160, the combined dispensing and venting conduit 161 divides into branch 162 leading to dispensing flow control valve 133 and consumer connection 134, and branch 163 leading to fill termination, quick-closing plug-type valve 138.

The section 135 of vapor vent conduit means which is outside container 120 and upstream uninsulated heat exchanger section 160 contains first flow restriction orifice 165. The orifice 165 should be large enough that it does not unduly restrict the expulsion of vapor from container 120 during a filling operation—hence that it does not unnecessarily slow the liquid transfer rate. It must be small enough to maintain the desired saturation pressure of liquid in the container 120 during the filling operation. Finally the first flow restriction 165 must be designed so that its $\Delta P$ is in proper proportion to other downstream flow resistances, i.e. conduit, vaporizer 160 on-off valve 139 and termination valve 138, such that the first flow resistance will preferably constitute 70–80% of the storage-dispensing container maximum gauge pressure.

The flow resistances in the vapor vent-fill termination circuit 135 are valve 138 together with the second fluid flow resistance, first flow resistance, orifice 165, uninsulated heat exchanger section 160 and the conduits 161 and 163. The flow resistance of the interconnecting conduits 161 and 163 is usually small, preferably less than 5% of the maximum storage-dispensing container 120 gauge pressure during transfer. The circuit 135 flow resistance between first flow resistance 165 and valve 138 is preferably less than 20% of the same maximum pressure. This is the aforementioned higher pressure length of the vapor vent conduit and the fluid flow constriction within such length should produce a pressure drop below this percentage. As a result the energy available in the pressure spike reading in the valve will be maximized. Orifice 165 as the first flow resistance means should preferably be designed to introduce the major part of the total pressure drop in the vent conduit fill termination circuit 135, preferably between 70% and 80% of the container 120 maximum gauge pressure during transfer. In normal practice orifice 165 will effectively reduce the inlet pressure to valve 138 to a value below its actuation (closing) point, yet the inlet pressure will be sufficiently near the value actuation point so that the appearance of cryogenic liquid in the vent-charging termination circuit will produce immediate and positive closure of valve 138.

The pressure drop across the quick-closing plug-type valve and second flow resistance means during vapor venting is preferably small—less than 10% of the storage-dispensing container maximum gauge pressure. This will avoid premature closure of the valve.

Figure 4:
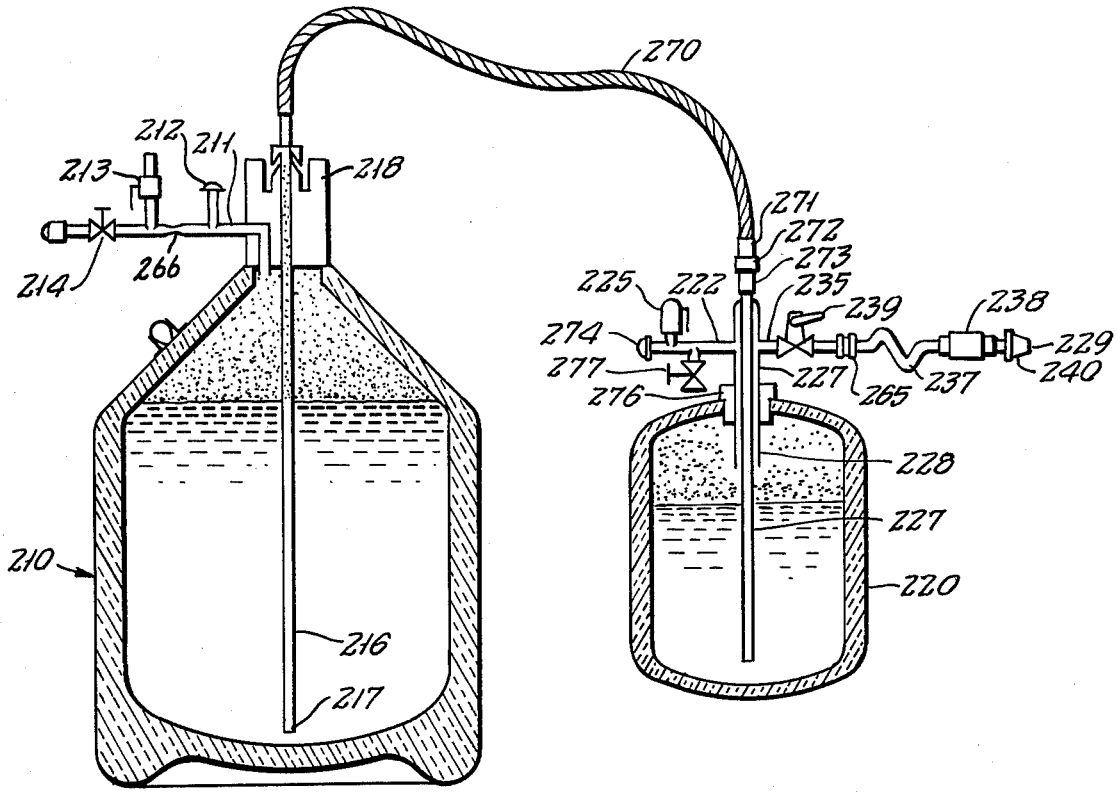
FIG. 4 is a schematic drawing in cross-sectional elevation of a cryogenic liquid supply container-storage and dispensing container assembly in the liquid fill position with the storage-dispenser upright, using a liquid fill termination system according to this invention.

FIG. 4 illustrates another cryogenic liquid storage-gas supply system utilizing the liquid transfer (fill) termination assembly of this invention. Liquid supply container 210 is similar to the corresponding containers of FIGS. 1 and 3, being provided with a vent gas safety relief assembly in conduit 211 comprising bursting disc 212, relief valve 213 and vent valve 214, all normally closed. Unlike FIGS. 1 and 3, liquid transfer conduit 216 in supply container 216 is coupled externally to liquid supply conduit 221 in portable container 220, rather than to the conduit functioning as the vapor phase conduit during the storage or dispensing operation of the portable container. The reason for this difference is that the portable dispensing container 220 and the liquid transfer (fill) termination circuit 235 remains upright during the filling operation rather than being inverted as shown in FIGS. 1 and 3. In FIG. 4, the external portion of liquid conduit 216 continues from coupling 218 as flexible conduit 270 with its other end attached to one portion 271 of coupling device 272.

The FIG. 4 portable liquid storage-gas supply assembly includes container 220 provided with liquid phase conduit 221 and vapor phase conduit 228. The external end of liquid phase conduit terminates in portion 273 of coupling device 272. Vapor phase conduit 228 is concentrically positioned around liquid phase conduit 221, and its external end is sealed around and to the exterior surface of conduit 221.

The external end 227 of vapor phase conduit 228 has two branches. One branch 222 provides a gas pressure relief circuit comprising relief valve 225 and bursting disc 274; if desired a vaporizer similar to item 24 may be provided to warm the fluid discharged through relief valve 213. The other branch of conduit 227 is the liquid transfer termination assembly 235 having sequentially therein first flow resistance means in the form of orifice flow restrictor 265, uninsulated conduit length 237, quick-closing plug-type valve 238, and optionally porous metal phase separator 240. Manual on-off valve 239 may be provided at any desired location in assembly 235 outside storage-dispensing container 220.

In order to fill portable container 220 from supply container 210, coupling 272 is engaged and manual valve 239 is opened. Coupling 272 may, for example, be the same self-sealing type as coupling 43 of FIG. 1. In this manner, a liquid conducting passage is established consisting of liquid phase conduit 216, flexible conduit 270 and liquid supply conduit 221. Supply container 210 contains a liquid cryogen saturated at super-atmospheric pressure of, for example, 30 psig, and liquid is forced to flow into container 220 under pressure difference between the two containers. Vapor which is generated due to cold liquid entering container 220 and displaced by such liquid, passes in flow-restricted manner through vapor phase conduit 228 and the aforedescribed liquid fill termination circuit 235 to atmosphere opening 229. When the liquid level in container 220 reaches the level of the inlet to vapor conduit 228, liquid will be passed along with vapor through first flow resistance 265 and into uninsulated conduit heat addition zone 237. Vaporization and expansion of the liquid occurring in uninsulated conduit 237 produces a large increase in flow rate through quick-closing plug-type valve 238 causing the latter to close. Pressures in the two containers will now equalize quickly and the liquid fill will be completed. Manual valve 239 is then closed and coupling 272 disconnected. The portable liquid storage-gas supply system is now ready for use to deliver its contents to consuming means as, for example, attaching a consumer hose similar to flexible conduit 270 to coupling 272.

Alternatively, coupling 272 need not be joined in order to place containers 210 and 220 in fluid communication. If portable container 220 is intended for low pressure service, e.g., near atmospheric pressure, neck plug 276 can be made removable from container 220 together with internal conduits 221 and 228 and external branches 222 and 235. In this instance, the liquid in supply container 210 would also be under low pressure sufficient merely to effect transfer and to expell the vapor from portable container 220 through the vapor ventfill termination system 235. Coupling 272 may be replaced by a manual on-off inlet valve and transfer commenced by inserting the neck plug and piping system, gas-tightly into portable container 220 and then opening the inlet valve. Manual on-off vent valve 239 is then not essential and may be omitted. The transfer is terminated as before by quick-closing plug-type valve 238, after which the inlet valve is closed. Residual pressure in portable container 220 may be vented for example through valve 277 and the neck plug with the piping system is then removed and is replaced by any suitable closure for safe storage and transport of the container. Upon relieving the residual pressure through valve 277 the quick-closing plug-type valve 238 will be reopened by its spring, and therefore valve 277 constitutes the required manual opening means in the system.

As a further alternative, it will be evident that the upright-portable container mode of transfer can be practiced without necessity for a flexible conduit such as item 270. Coupling portions 271 and 273 can be rigidly affixed to the supply container 210 and the portable container 220 respectively, with appropriate location and orientation for joining in the upright, side-by-side position.

Figure 5:
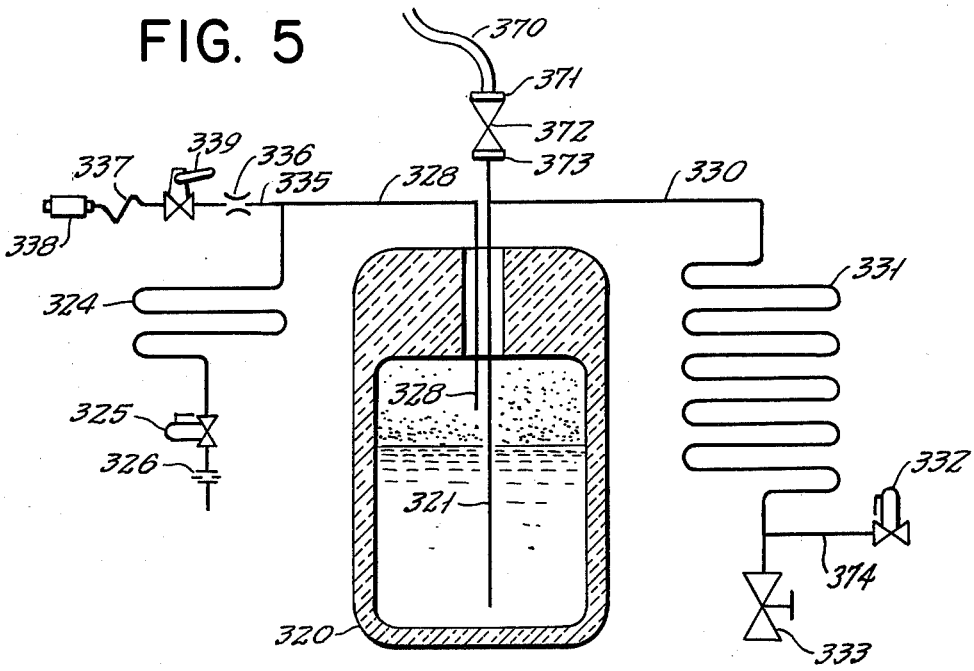
FIG. 5 is a schematic drawing of yet another liquid fill assembly similar to FIG. 4, but with a signal circuit to actuate the quick-closing plug-type valve which is separate from the circuit containing second vaporizer 331.

FIG. 5 illustrates yet another embodiment of the invention adapted for upright filling. As in FIG. 4, container 320 may be connected to a liquid supply reservoir (not shown) through a flexible conduit 370 by joining self-closing coupling 372. Liquid phase line 321 continues externally through branch conduit 330 to second vaporizer 331 and to gas dispensing flow selector valve 333. Branch conduit 374 connected into the dispensing system downstream vaporizer 331 contains secondary relief valve 332 and the latter serves the back-up relief function of valve 32 in FIG. 1.

In FIG. 5 the vapor phase conduit 328 divides externally of portable container 320 into the primary pressure relief system in branch conduit 322 and the liquid transfer termination assembly 335. The primary relief system comprises first vaporizer 324, flow snubber 326 and relief valve 325. The liquid transfer termination assembly 335 comprises first flow restrictor 336, on-off manual valve 339, uninsulated conduit heat addition zone 337 and quick-closing plug-type valve 338. The various components serve functions similar to corresponding items in previously described embodiments.

The basic difference between the inverted-fill embodiments (FIGS. 1 and 3) and the upright-fill embodiments (FIGS. 4 and 6) is the location of the liquid transfer termination assembly system. In the inverted-fill embodiments, the fill termination assembly is branched off the liquid phase conduit of the cryogenic liquid storage-dispensing container, i.e. it is branched off the conduit which extends farthest into the container. Thus, in the inverted-fill position this conduit reverses its function and opens into the vapor zone above the liquid level. In the upright-fill embodiments, the fill termination assembly is branched off the vapor phase conduit, i.e. it is branched off the conduit which extends to a location in the container near the conduit entry. This is because there is no change in function of this conduit between the filling and dispensing modes of operation.

Figure 6:
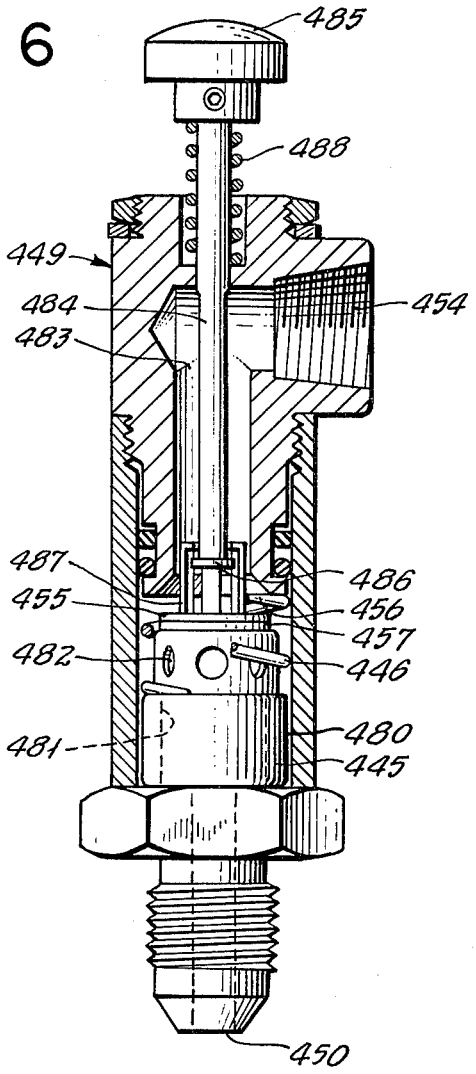
FIG. 6 is a cross-sectional view of another quick-closing plug-type valve suitable for use in the present invention and combining the functions of manual on-off valve 39 and valve 38 of FIG. 1.

FIG. 6 illustrates another quick-closing plug-type valve and manual opening means 449 which is preferred in the practice of the cryogenic liquid transfer termination assembly of this invention. This valve is not our invention and represents the claimed subject matter in copending U.S. patent application Ser. No. 125,793 filed Feb. 29, 1980 in the name of R. L. Zeunik. The FIG. 6 apparatus combines the functions of the quick-closing valve 38 and manual on-off valve 39 as illustrated for example in the FIG. 1 embodiment. The combined apparatus is more compact, lower in cost and lighter in weight than the separate components.

Referring now to FIG. 6, fluid enters valve inlet 450 and is discharged through outlet 454. The plug movement means comprises piston 445 which is axially movable between the illustrated full-open position to the full-closed position. The piston 445 is biased to the open position by mechanical spring 446 retained against the enlarged end 480 of piston 445. The latter has an axial internal cavity 481 open toward valve inlet 450. The internal cavity communicates with the interior of the valve body through lateral ports 482 in the piston side wall, which ports function as the second flow resistance means of the invention.

Fluid entering valve inlet 450 flows through piston internal cavity 481, transversely through ports 482 into the stem housing 483 for axial flow therethrough and discharge through outlet 454. When the fluid flow velocity increases to a predetermined value, it exerts sufficient force against the internal, inlet facing surface 457 of cavity 481 as the plug movement means second end to axially move the piston away from the inlet. Sealing surface 455 on this piston inner end represents the previously defined plug member, and is forced against seat 456 and terminates the fluid flow. The valve will remain closed as long as the pressure differential across the seat remains sufficient to overcome the counteracting force of spring 446.

The manual on-off feature is provided by stem 484 with external knob 485. The internal end of stem 484 has a flange 486 which is loosely caged in retainer 487 fixed to the piston 445. Stem 484 is held in the outward or retracted position by spring 488, the latter being retained between the valve body and knob 485. The distance between flange 486 and the closed end of piston 445 allows limited axial motion of the piston independent of stem 484. This axial freedom is sufficient so that the piston can move to the closed position without resistance or constraint by the stem 484.

When the valve 449 is closed, it can be manually opened by pressing knob 485 inwardly. This forces flange 486 against the closed end of piston 445 and disengages sealing surfaces 455–456. The differential pressure tending to force the plug 455 against the seat is thereby reduced, and flow is again established through the valve. If the rate of flow is below the critical value for closure, the valve will remain open after pressure on knob 485 is removed.

When the valve 449 is open, it can be manually closed by pulling knob 485 outwardly. Flange 486 is thereby drawn against the inner end surface of retainer 487, and the piston 445 is pulled by the stem 484 against the force of spring 446 to the closed position. Once sealing surfaces 455–456 are engaged, flow will cease, the pressure drop across the plug member 455 will increase and the valve will remain in the closed position after tension on the stem 484 is removed.

The mode of operation of the combined valvemanual opening means 449 of FIG. 6 in a system such as FIG. 1 will now be apparent. The combined apparatus 449 will replace manual on-off valve 39 and the FIG. 2 valve 38. In order to initiate liquid transfer, it is only necessary to press knob 485. When the liquid storage-dispensing container is filled, valve 449 will close automatically and will remain closed until the container again requires refilling. The manual opening provision incorporated into the valve of FIG. 6 not only eliminates the need for a separate on-off valve, but also eliminates the necessity for notching or scoring the plug or seat in order to relieve upstream pressure.

Figure 7:
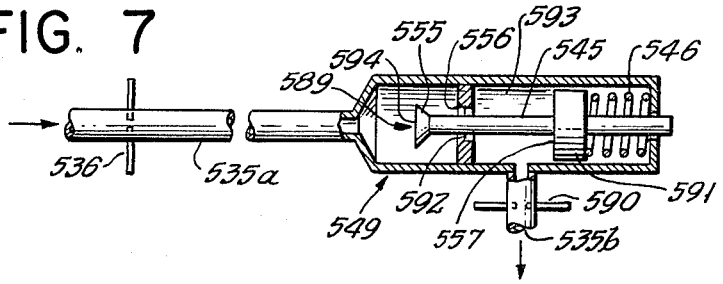
FIG. 7 is a cross-sectional view of still another suitable quick-closing plug-type valve assembly with the plug movement means comprising a stem and piston downstream the plug, and an orifice as the second flow resistance.

FIG. 7 schematically illustrates still another type of quick-closing plug-type valve 549 and flow resistance means suitable for practicing the invention, and differing in certain particulars from the FIGS. 2 and 6 valves. In the latter, the plug movement means is upstream the plug member (relative to fluid flow). In FIG. 7, the plug movement means is downstream the plug member. Another distinctive feature of the FIG. 7 assembly is the second flow resistance means. Whereas in FIGS. 2 and 6 the second flow resistance means is part of the valve construction, in FIG. 7 an orifice 590 downstream of the valve constitutes the second flow resistance.

More specifically, in FIG. 7 inlet conduit 535*a* joins the inlet of valve 549 and includes first flow resistance means in the form of orifice 536 as well as a non-thermally insulated conduit length. Stem 545 extends axially through the valve body with a first end rigidly secured to plug member part 555 of conical part 589 and a second end secured to one surface 557 of piston 591. Mechanical spring 546 is biased against the opposite surface of piston 591 to maintain the valve in the open position. Branch conduit 535*b* joins the valve body on the discharge side for fluid flow therefrom. The seat for plug 555 is provided by the inner edge 556 of an annular ring transversely positioned on the valve body.

If the annular flow opening 592 between stem 545 and seat 556 is large relative to second flow resistance orifice 590, then the pressure in valve chamber 593 will be greater than atmospheric. The pressure pulse which passes through opening 592 is applied against the aforementioned one surface 557 of piston 591 as the plug movement means second end to move plug member 555 against seat 556 and close the valve. Once this occurs the pressure in valve chamber 593 bleeds down through second flow resistance orifice 590 in branch conduit 535*b*. Simultaneously however, the high pressure difference across upstream first flow resistance orifice 536 drops to zero and the full pressure of the storage-dispensing container is then applied against the upstream surface 594 of conical part 589. This holds the valve closed despite loss of pressure against piston 591. Thus, the piston 591 and stem 545 is the plug movement means from open to closed positions, but after closure the operative function which holds the plug member closed is transferred to the upstream surface 594 of conical part 589 as part of the plug movement means second end 557.

Figure 8:
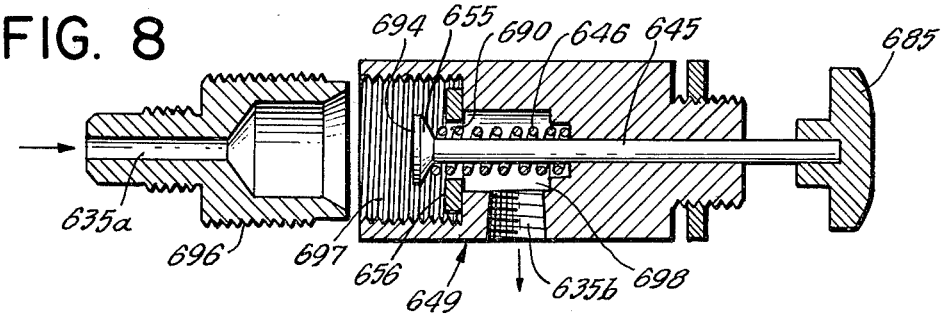
FIG. 8 is a cross-sectional view of an additional suitable quick-closing plug type valve assembly with the plug movement means including the upstream surface of the same member whose downstream surface forms the valve plug.

FIG. 8 illustrates a further type of quick-closing plug valve 649 similar in certain respects to the FIG. 7 assembly but having a second flow resistance means within the valve. The first flow resistance means is not illustrated but may for example be an orifice of the type shown in FIG. 7 as item 536. Inlet passageway 635*a* is provided in male fitting 696 which leak-tightly joins the valve body to form higher pressure chamber 697. Stem 645 extends axially through the valve body with a first end rigidly secured to plug member part 655 of conical part 689 and a second end secured to knob 685. Mechanical spring 646 is axially positioned around stem 645 and biased at opposite ends between conical part 689 and a recess section of the valve lower pressure chamber 698. Gas is discharged through side opening 635*b* in flow communication with lower pressure chamber 698. The seat for plug member 655 is provided by the inner edge 656 of an annular ring transversely positioned in the valve body.

In FIG. 8, the upstream surface 694 of conical part 689 whose downstream surface forms plug member 655, constitutes the plug movement means second end. Also, the second flow resistance is the region of narrowest passage constriction 690 between seat 656 and the surface of plug member 655. This constriction produces a lower pressure in the annulus between the seat and the stem 645 than exists in the upstream chamber 697 against surface 694. Thus, the second flow resistance is downstream the plug movement means.

This invention will be more fully understood by the following description of working examples in which liquid oxygen was transferred from the supply container at various pressures in the 20–68 psig range to a smaller storage-dispensing container. The system used for these experiments was the FIG. 3 embodiment with a supply container 110 having a capacity of 40.4 lbs. liquid oxygen and an inverted storage-dispensing container 120 having a nominal full capacity of 1.5 liquid oxygen. Orifices 165 were provided in the range of 0.047 inch diameter for the 40–68 psig supply container experiments up to 0.070 inch diameter for certain of the 20 psig supply container experiments. The orifice 165 was upstream uninsulated heat exchanger (vaporizer) 160 fabricated from ¼ inch diameter tube 15 ft. 9 in. long. A ¼ inch quick-closing plug-type valve as illustrated in FIG. 8 was installed as valve 139 in the FIG. 3 system and fitted with a light spring 646 designed to close when passing ambient air to the atmosphere with an upstream pressure of about 7 psig.

In the 40–68 psig. supply pressure tests it was determined that the total transfer time (required to charge container 120) exerts a significant effect on loss of cryogenic liquid during transfer. That is, over a range of about 2–4 minutes transfer times for both cold and warm fills in which the loss was in the range of about 0.5 to 0.8 pounds oxygen, the transfer loss increased in an approximate linear relationship with increasing transfer times. With an initially warm storage container, transfer times greater than about 2.5 minutes were observed and as transfer times increased to 3.6 minutes, the transfer losses also increased by a factor of about 1.3 with losses eventually exceeding one-half the nominal full capacity of the storage container 120. With an initially cold storage container, fill times less than about 2.5 minutes were observed and the oxygen losses were less than about one-third the nominal full capacity. Transfer times were varied in the 40–68 psig supply container tests by varying the equilibrium pressure of liquid oxygen in this container. Higher container pressures increased the pressure difference across the vent-fill termination circuit for expelling vapor, and decreased the transfer time. Since the cryogenic liquid transfer termination assembly of this invention must accommodate transfers into either a warm or cold storage-dispensing container, rapid transfer is highly desirable and on this basis a relatively high supply container pressure of at least 40 psig is preferred.

It is desirable that the quick-closing plug type valve be kept warm during cryogenic liquid transfer from the supply to the storage-dispensing container. If the valve becomes deeply chilled during the transfer, the risk is incurred that moisture from the surrounding air may be drawn into the valve by condensation after the fill is terminated. On a subsequent transfer, such condensed moisture may freeze and obstruct free operation of the valve. Valve temperature measurements taken in the aforedescribed liquid oxygen tests showed that valve temperatures are maintained at much warmer levels with higher 40–68 psig supply pressure than at lower 20 psig pressure. This is attributed at least in part to the more rapid transfer associated with the higher supply pressure. In preferred practice, the first fluid flow resistance means is sufficiently large and sufficient warming capacity is provided by the uninsulated length of the vapor vent conduit (between the first flow resistance means and the quick-closing plug-type valve) so as to maintain the valve at temperature of at least 15° F.

The data from the aforedescribed tests is summarized in Tables I, II for the supply container at 40–68 psig and Tables III, IV for the supply container at 20 psig. With the exception of the first flow resistance means orifice 165 and different bias springs for the flow termination valve (7 psig closure for higher pressure test and about 3 psig closure for 20 psig tests), the same apparatus was used in all tests. Since the same conduits were used in the low pressure tests as the high pressure tests, larger orifices 165 were used in the former to reduce the total flow resistance of the system. This had the effect of shifting a large fraction of the total pressure drop (from the liquid storage-dispensing container 120 through the vent-flow termination circuit 135 to the atmosphere) from orifice 165 to the other components in the circuit.

TABLE I

| Supply Container 110 Psig | Dispenser 120 Initial Temp. | Transfer Time Min. | Transfer Loss Lbs. $O_2$ | Valve 139 Temp. End Of Fill °F. | Valve 139 Delay Min. |
|---|---|---|---|---|---|
| 40 | Warm | 3.60 | 0.77 | 24.5 | 0.11 |
| 54 | Warm | 2.57 | 0.60 | 32.7 | 0.09 |
| 40 | Cold | 2.49 | 0.51 | 18.5 | 0.10 |
| 54 | Cold | 2.35 | 0.58 | 27.7 | 0.06 |

TABLE I-continued

| Supply Container 110 Psig | Dispenser 120 Initial Temp. | Transfer Time Min. | Transfer Loss Lbs. $O_2$ | Valve 139 Temp. End Of Fill °F. | Valve 139 Delay Min. |
|---|---|---|---|---|---|
| 68 | Cold | 1.95 | 0.52 | 27.8 | 0.06 |

TABLE II

| Supply Container 110 Psig | Dispenser 120 Initial Temp. | Dispenser 120 Psig | Heat Exchg. 160 P psi | Heat Exchg. 160 P % of Disp. Pressure | Orifice 165 P psi | Orifice 165 P % of Disp. Pressure | Valve 139 Inlet Pres. psi | Valve 139 Inlet Pres. % of Disp. Pressure |
|---|---|---|---|---|---|---|---|---|
| 45 | Warm | 38.4 | 6.8 | 17.7 | 29.3 | 76.3 | 1.2 | 3.1 |
| 56 | Warm | 53.2 | 8.6 | 16.2 | 40.8 | 76.7 | 2.2 | 4.1 |
| 45 | Cold | 39.5 | 8.4 | 21.3 | 28.5 | 72.2 | — | — |
| 56 | Cold | 51.8 | 8.2 | 15.8 | 38.7 | 74.7 | 2.7 | 5.2 |
| 68 | Cold | 64.8 | 10.6 | 16.6 | 48.0 | 74.1 | 4.1 | 6.3 |

TABLE III

| Dispenser 120 Initial Temp. | Orifice 165 Diam. Inch | Transfer Time Min. | Transfer Loss Lbs. $O_2$ | Valve 139 Temp. End of Fill °F. | Valve Delay Min. |
|---|---|---|---|---|---|
| Warm | 0.055 | 5.24 | 0.78 | 0 | 0.05 |
| Warm | 0.055 | 5.25 | 0.80 | +5 | 0.06 |
| Warm | 0.063 | 4.37 | 0.65 | −12 | 0.08 |
| Warm | 0.067 | 4.07 | 0.61 | −14 | 0.06 |
| Cold | 0.055 | 3.40 | 0.53 | +15 | 0.07 |
| Cold | 0.055 | 3.51 | 0.62 | −1 | 0.13 |
| Cold | 0.055 | 4.51 | 0.64 | −2 | 0.08 |
| Cold | 0.055 | 4.90 | 0.92 | −15 | 0.13 |
| Cold | 0.067 | 2.97 | 0.50 | +18 | 0.03 |
| Cold | 0.067 | 3.25 | 0.61 | −4 | 0.12 |
| Cold | 0.070 | 3.65 | 0.58 | 0 | 0.10 |

TABLE IV

| Dispenser 120 Initial Temp. | Orifice 165 Diam. Inch | Heat Exchg. 160 P psi | Heat Exchg. 160 P % of Disp. Pressure | Orifice 165 P psi | Orifice 165 P % of Disp. Pressure | Valve 139 Inlet Pres. psi | Valve 139 Inlet Pres. % of Disp. Pressure |
|---|---|---|---|---|---|---|---|
| Warm | 0.063 | 5.16 | 31 | 8.0 | 48 | 1.75 | 11 |
| Warm | 0.067 | 5.66 | 33 | 7.0 | 41 | 2.35 | 14 |
| Warm | 0.055 | 3.90 | 23 | 9.6 | 56 | 2.00 | 12 |
| Warm | 0.055 | 4.40 | 27 | 9.5 | 58 | 1.20 | 7 |
| Cold | 0.055 | 4.33 | 25 | 8.7 | 50 | 1.84 | 11 |
| Cold | 0.055 | 4.00 | 24 | 8.9 | 52 | 1.52 | 9 |
| Cold | 0.055 | 4.50 | 27 | 8.8 | 52 | 1.70 | 10 |
| Cold | 0.055 | 4.12 | 24 | 8.8 | 52 | 1.64 | 9 |
| Cold | 0.067 | 5.50 | 33 | 6.0 | 36 | 2.00 | 12 |
| Cold | 0.067 | 5.16 | 30 | 5.8 | 34 | 2.68 | 16 |
| Cold | 0.070 | 5.83 | 34 | 7.0 | 41 | 2.67 | 10 |

Comparison of the data in Tables I–IV supports the following conclusions:

(1) Reducing the supply container pressure from 68 psig to 20 psig increases the transfer time required to fill the storage-dispensing container irrespective of whether the latter is initially warm or cold.

(2) When the storage-dispensing container is initially warm, there is a cooldown cryogenic liquid loss irrespective of the supply container pressure level, and this loss tends to mask the effect of transfer time on liquid loss.

(3) Liquid transfer loss is minimized by holding the transfer time to below 3 minutes.

(4) At comparable conditions, a higher supply container pressure (eg. 40 psig) tends to result in lower cryogenic liquid transfer losses than lower supply container pressure (eg. 20 psig). This is in part because of the more rapid transfer associated with the higher pressure.

(5) At comparable conditions, a higher supply container pressure (eg. 40 psig) makes the ventliquid transfer control system more sensitive for flow termination than lower supply container pressure (eg. 20 psig). This was demonstrated by the extent of overfill above the desired 1.5 lbs. liquid oxygen nominal capacity of the storage-dispensing container: 20% for 20 psig and 10% for 40–68 psig.

The data in Table 1 also displays the operating stability of the cryogenic liquid transfer termination assembly over a relatively wide range of supply container pressures. Valve 139 temperatures were maintained at high levels and transfer losses were low throughout the 40–68 psig pressure range. This is a desirable characteristic of the system inasmuch as supply pressure depends upon the total heat absorbed by the liquid prior to the transfer. Total heat absorption in turn depends upon such variables as insulation effectiveness and liquid storage time. Therefore in actual practice the supply pressure cannot be rigidly controlled.

Although certain embodiments of the invention have been described in detail, it will be understood that other embodiments are contemplated and that modifications of the disclosed features are within the scope of the invention.

What is claimed is:

1. In a cryogenic liquid storage-gas supply system including a thermally insulated cryogenic liquid supply container, a thermally insulated cryogenic liquid storage-dispensing container, liquid transfer conduit means with an inlet end terminating in the bottom part of said supply container and a discharge end terminating in said storage-dispensing container, vapor vent conduit means with an inlet end terminating in the upper part of said storage-dispensing container in the liquid transfer position and an outlet end outside the containers and open to the atmosphere: the improvement of a cryogenic liquid transfer termination assembly comprising:

(a) first fluid flow resistance means in said vapor vent conduit means;

(b) a quick-closing plug-type valve in said vapor vent conduit means being positioned between said first fluid flow resistance means and the vapor vent conduit means outlet end, and: (i) being separated from said first fluid flow resistance means by an uninsulated length of said vapor vent conduit, (ii) having a valve seat, (iii) a plug member contiguously positioned against the upstream surface of said valve seat, (iv) mechanical spring means positioned to urge said plug away from said valve seat, and (v) plug movement means having a first end rigidly joined to said plug and a second end in fluid communication with said first fluid flow resistance means through a higher pressure length of said vapor vent conduit;

(c) said higher pressure length of said vapor vent conduit being arranged and constructed without substantial fluid flow constriction when the plug is urged away from said seat;

(d) second fluid flow resistance means having less fluid flow resistance than said first fluid flow resistance means, and positioned between said plug movement means second end and the vapor vent conduit means outlet end to provide a lower pressure length; and (e) manual opening means for said quick-closing plug-type valve, positioned within said vapor vent conduit means outside said storage-dispensing container.

2. Apparatus according to claim 1 wherein said mechanical spring means is biased so as to both: (a) permit said plug member to position against said valve seat for closing when ambient air flows thereagainst from said vapor conduit means inlet end with an upstream pressure less than 25% of the storage-dispensing container maximum gauge pressure during cryogenic liquid transfer, but (b) to maintain said plug member away from said valve seat in the open condition when ambient air flows therethrough from said vapor conduit means inlet and with an upstream pressure of at least 5% of the storage dispensing container maximum gauge pressure during cryogenic liquid transfer.

3. Apparatus according to claim 2, wherein said first flow resistance means (a) is constructed so as to reduce the fluid inlet pressure to below 7 psig when venting vapor only, and said mechanical spring means is biased to permit said plug member to position against the valve seat for closing with 7 psig ambient air flowing thereagainst from said vapor conduit means inlet end.

4. Apparatus according to claim 1 wherein said vapor vent conduit is constructed such that its flow resistance between said first fluid flow resistance means and said quick-closing plug-type valve is less than 20% of the storage-dispensing container gauge maximum pressure during cryogenic liquid transfer.

5. Apparatus according to claim 1 wherein said first fluid flow resistance means is an orifice constructed such that its flow resistance is 70–80% of the storage-dispensing container maximum gauge pressure during cryogenic liquid transfer.

6. Apparatus according to claim 1 wherein said first fluid flow resistance means is sufficiently large and uninsulated length of vapor vent conduit is constructed with sufficient vent fluid warming capacity to maintain said quick-closing plug-type valve at temperature of at least 15° F. during vent fluid flow therethrough.

7. Apparatus according to claim 1 wherein said quick-closing plug-type valve and said second fluid flow resistance means are constructed such that the pressure drop thereacross is less than 10% of the storage-dispensing container maximum gauge pressure when venting vapor only during cryogenic liquid transfer.

* * * * *